US007878820B2

(12) United States Patent
Tada et al.

(10) Patent No.: US 7,878,820 B2
(45) Date of Patent: Feb. 1, 2011

(54) CONNECTOR DEVICE FOR INTERCONNECTING CIRCUIT SUBSTRATES

(75) Inventors: Morio Tada, Toyama (JP); Satoshi Ueno, Toyama (JP); Satoru Takasaki, Toyama (JP)

(73) Assignee: Hokuriku Electric Industry Co., Ltd., Toyama-shi (JP)

( * ) Notice: Subject to any disclaimer, the term of this patent is extended or adjusted under 35 U.S.C. 154(b) by 0 days.

(21) Appl. No.: 12/443,322

(22) PCT Filed: Aug. 29, 2007

(86) PCT No.: PCT/JP2007/066775

§ 371 (c)(1),
(2), (4) Date: Jun. 18, 2009

(87) PCT Pub. No.: WO2008/041432

PCT Pub. Date: Apr. 10, 2008

(65) Prior Publication Data

US 2010/0003839 A1 Jan. 7, 2010

(30) Foreign Application Priority Data

Sep. 29, 2006 (JP) ..... 2006-269651

(51) Int. Cl.
*H01R 12/00* (2006.01)

(52) U.S. Cl. ..... 439/67; 439/495

(58) Field of Classification Search ..... 439/65–69, 439/74, 493, 495, 499

See application file for complete search history.

(56) References Cited

U.S. PATENT DOCUMENTS 4,695,258 A * 9/1987 Hanson et al. ..... 439/67
5,219,293 A * 6/1993 Imamura ..... 439/67
5,642,441 A * 6/1997 Riley et al. ..... 382/255
5,890,915 A * 4/1999 Reylek ..... 439/91
6,403,226 B1 6/2002 Biernath
7,425,158 B2 * 9/2008 Ookura ..... 439/660
7,731,510 B2 * 6/2010 Tada et al. ..... 439/91

(Continued)

FOREIGN PATENT DOCUMENTS

JP 09-092365 4/1997

(Continued)

*Primary Examiner*—Ross N Gushi
(74) *Attorney, Agent, or Firm*—Rankin, Hill & Clark LLP

(57) ABSTRACT

A connector device for interconnecting circuit substrates is obtained, in which a pitch for electrically conducting paths can easily be aligned with a pitch for electrodes on the side of circuit substrates. The connector includes a rectangular parallelepiped connecting element (9) and a connector housing (11). The rectangular parallelepiped connecting element (9) has a plurality of electrically conducting paths disposed on a rectangular parallelepiped insulating base thereof at an insulating interval and the connector housing (11) is mounted on a first circuit substrate (1) with the rectangular parallelepiped connecting element (9) received therein. The connector housing (11) allows an electrically conducting path portion of the rectangular parallelepiped connecting element (9) to be electrically connected to first connecting electrodes disposed on the first circuit substrate (1), receives a substrate portion of a second substrate (5) where second connecting electrodes are disposed, and brings the electrically conducting path portion of the rectangular parallelepiped connecting element (9) and the second connecting electrodes of the second circuit substrate (5) into contact with each other.

7 Claims, 13 Drawing Sheets

U.S. PATENT DOCUMENTS

| | | | | |
|---|---|---|---|---|
| 2005/0009383 | A1* | 1/2005 | Okura et al. | 439/74 |
| 2006/0264075 | A1* | 11/2006 | Obikane et al. | 439/74 |
| 2009/0253275 | A1* | 10/2009 | Tada et al. | 439/66 |

FOREIGN PATENT DOCUMENTS

| | | |
|---|---|---|
| JP | 2003-203688 | 7/2003 |
| JP | 2004-265599 | 9/2004 |
| JP | 2005-149812 | 6/2005 |
| JP | 2005-158360 | 6/2005 |

* cited by examiner

CONNECTOR DEVICE FOR INTERCONNECTING CIRCUIT SUBSTRATES

TECHNICAL FIELD

The present invention relates to a connector device for interconnecting circuit substrates that is used to electrically connect a plurality of first and second connecting electrodes, which are juxtaposed on a surface of first and second circuit substrates at a pitch for electrodes respectively.

BACKGROUND ART

Typically, a connector device for interconnecting circuit substrates of this kind has a pitch of at least 0.2 mm for electrically conducting paths and the conducting paths arranged at a patch of 0.4 mm are zigzag aligned or staggered. (See Patent Document 1, Japanese Patent Application Publication No. 2004-265599 or JP2004-265599A, for example).

DISCLOSURE OF THE INVENTION

Problems to be Solved by the Invention

In the connector device for interconnecting circuit substrates configured in such a manner, however, even though a pitch for electrodes on circuit substrates can be reduced to 0.06 mm for example, the reduction of pitch for electrodes is limited by a pitch for electrically conducting paths on the side of connector device because the pitch for electrically conducting paths cannot be reduced below 0.2 mm. In the connector device having a pitch of 0.2 mm pitch for electrically conducting paths, the conducting paths are zigzag aligned or staggered. Consequently, there is a space between both contact portions of one group of the electrically conducting paths and those of the other group of the electrically conducting paths, thereby requiring a larger mounting dimension.

An object of the present invention is to provide a connector device for interconnecting circuit substrates in which the pitch for electrically conducting paths can be aligned easily with the pitch for electrodes on the side of circuit substrates.

Another object of the present invention is to provide a connector device for interconnecting circuit substrates in which the pitch for electrically conducting paths can be aligned easily with the pitch for electrodes on the side of circuit substrates, and electrical interconnection can be made between two circuit substrates even if the two circuit substrates to be interconnected have a different pitch for electrodes.

A further object of the present invention is to provide a connector device for interconnecting circuit substrates in which the pitch for electrically conducting paths can be aligned easily with the pitch for electrodes on the side of circuit substrates, and interconnection can be made by fitting with each other.

Means for Solving the Problem

A connector device for interconnecting circuit substrates of the present invention is basically used to electrically connect a plurality of first connecting electrodes disposed on a first circuit substrate and a plurality of second connecting electrodes disposed on a second circuit substrate.

In the connector device for interconnecting circuit substrates of the present invention, the plurality of first connecting electrodes are juxtaposed on a surface of the first circuit substrate at a given pitch for electrodes, and the plurality of second connecting electrodes are juxtaposed on a surface of the second circuit substrate at a given pitch for electrodes. The given pitch may be 0.2 mm or less.

In particular, the connector device for interconnecting circuit substrates comprises a rectangular parallelepiped connecting element and a connector housing. The rectangular parallelepiped connecting element includes a rectangular parallelepiped insulating base having four continuous faces and two opposed faces, and a plurality of electrically conducting paths that are juxtaposed on at least three continuous faces of the four continuous faces of the insulating base at a given insulating interval in a direction where the two opposed faces are arranged. The pitch for electrically conducting paths of the plurality of electrically conducting paths is substantially equal to the pitch for electrodes on the circuit substrate.

The connector housing is mounted onto the first circuit substrate with the rectangular parallelepiped connecting element being received therein. The connector housing is configured to allow a plurality of electrically conducting path portions disposed on one of the two opposed faces of the three continuous faces of the rectangular parallelepiped connecting element to be electrically connected to the plurality of first connecting electrodes that are disposed on the first circuit substrate. The connector housing is also configured to receive a substrate portion of the second circuit substrate where the plurality of second connecting electrodes are disposed and hold the substrate portion in a position where the plurality of electrically conducting path portions disposed on the other face of the two opposed faces of the three continuous faces of the rectangular parallelepiped connecting element are opposed to the plurality of second connecting electrodes. The connector housing is further configured to bring the plurality of second connecting electrodes into contact with the plurality of electrically conducting path portions disposed on the other face.

Since the connector device for interconnecting circuit substrates configured in this manner employs the rectangular parallelepiped insulating base having four continuous faces and two opposed faces and the plurality of electrically conducting paths disposed on at least three continuous faces of the four continuous faces of the insulating base at a given insulating interval in the direction where the two opposed faces are arranged, the pitch for electrically conducting paths of the plurality of electrically conducting paths disposed on the rectangular parallelepiped insulating base can be defined substantially equal to the pitch for electrodes on the circuit substrate with ease. As a result, the pitch for electrically conducting paths on the surface of the insulating base can easily be aligned with the pitch for electrodes on the side of the circuit substrate. Since the conducting paths are not zigzag aligned or staggered on the insulating base, the pitch for electrically conducting paths is small, thereby saving a space in the arrangement direction of the conducting paths, and accordingly an implementation dimension. Accordingly, miniaturization of connector devices can thus be realized easily according to the present invention. Further, the connector device includes the connector housing that is mounted onto the first circuit substrate with the rectangular parallelepiped connecting element received therein. The connector housing is configured to allow the plurality of electrically conducting path portions disposed on one of the two opposed faces of the three continuous faces of the rectangular parallelepiped connecting element to be electrically connected to the plurality of first connecting electrodes that are disposed on the first circuit substrate. The connector device is also configured to receive the substrate portion of the second circuit substrate where the plurality of second connecting electrodes are disposed and hold the substrate portion in a position where the plurality of electrically conducting path portions disposed on the other face of the two opposed faces of the three continuous faces of the rectangular parallelepiped connecting element are opposed to the plurality of second connecting electrodes. For this reason, the plurality of first connecting electrodes on the first circuit substrate and the plurality of second connecting electrodes on the second circuit substrate can electrically be connected easily with the positioning operation of the connector housing. The plurality of second connecting electrodes on the second circuit substrate can positively be brought into contact with the plurality of electrically conducting path portions disposed on the other one of the two opposed faces of the three continuous faces of the rectangular parallelepiped connecting element. According to the connector device for interconnecting circuit substrate of this type, the first circuit substrate and the second circuit substrate can electrically be connected in parallel to each other.

According to the present invention, a connector device for interconnecting circuit substrate of a type which includes a rectangular parallelepiped connecting element and a connector housing may be configured as described below.

The rectangular parallelepiped connecting element includes a rectangular parallelepiped insulating base having four continuous faces and two opposed faces, and a plurality of electrically conducting paths that are juxtaposed on at least two continuous faces of the four continuous faces of the insulating base, at a given insulating interval in a direction where the two opposed faces are arranged so that a pitch for electrically conducting paths of a plurality of electrically conducting paths may be substantially equal to a pitch for electrodes. A connector housing is mounted onto a first circuit substrate with the rectangular parallelepiped connecting element received therein. The connector housing is configured to allow a plurality of electrically conducting path portions disposed on one of the two continuous faces of the rectangular parallelepiped connecting element to be electrically connected to a plurality of first connecting electrodes that are disposed on the first circuit substrate. The connector housing is also configured to receive a substrate portion of a second circuit substrate where a plurality of second connecting electrodes are disposed and hold the substrate portion in a position where a plurality of electrically conducting path portions disposed on the other face of the two continuous faces of the rectangular parallelepiped connecting element are opposed to the plurality of second connecting electrodes. Further, the connector housing is configured to bring the plurality of second connecting electrodes in contact with the plurality of electrically conducting path portions disposed on the other face.

The connector device for interconnecting circuit substrates configured in this manner makes it possible to electrically connect the first and second circuit substrates in directions orthogonal to each other. Other effects are approximately similar to those of the foregoing type in which the first and second circuit substrates are interconnected in parallel to each other.

In another connector device for interconnecting circuit substrates according to the present invention, a plurality of first connecting electrodes are juxtaposed on a surface of a first circuit substrate at a first pitch for electrodes, and a plurality of second connecting electrodes are juxtaposed on a surface of a second circuit substrate at a second pitch for electrodes different from the first pitch for electrodes. The first and second pitches for electrodes may be 0.2 mm or less.

In particular, the connector device for interconnecting circuit substrates of the present invention includes a rectangular parallelepiped connecting element and a connector housing. The rectangular parallelepiped connecting element includes a rectangular parallelepiped insulating base having four continuous faces and two opposed faces, and a plurality of electrically conducting paths that are juxtaposed on at least three continuous faces of the four continuous faces of the insulating base at an insulating interval respectively in a direction where the two opposed faces are arranged. The plurality of electrically conducting paths include a plurality of first electrically conducting path portions formed on one of the two opposed faces of the three continuous faces at a first pitch for electrically conducting paths equal to the first pitch for electrodes, and a plurality of second electrically conducting path portions formed on the other of the two opposed faces of the three continuous faces at a second pitch for electrically conducting paths equal to the second pitch for electrodes. The rectangular parallelepiped connecting element further includes a plurality of third electrically conducting path portions formed on the rest of the three continuous faces for connecting the plurality of first electrically conducting path portions and the plurality of second electrically conducting path portions respectively for pitch conversion. Other configuration aspects are similar to those of the above-mentioned connector device for interconnecting circuit substrates in which the first and second circuit substrates having substantially the same pitch are connected.

In the connector device for interconnecting circuit substrates configured in this manner, the plurality of electrically conducting paths of the rectangular parallelepiped connecting element include the plurality of first electrically conducting path portions disposed on one of the two opposed faces of the three continuous faces of the rectangular parallelepiped connecting element at the first pitch for electrically conducting paths equal to the first pitch for electrodes. The plurality of electrically conducting paths further include the plurality of second electrically conducting path portions disposed on the other of the two opposed faces of the three continuous faces. The plurality of electrically conducting paths further include the third electrically conducting path portions for pitch conversion that connect the plurality of first and second electrically conducting path portions that are disposed on the rest of the three continuous faces. As a result, even if the pitch for electrodes of first circuit substrate differs from that of the second circuit substrate, electrical connection can be realized easily. Other effects obtained from this configuration are similar to those of the above-mentioned connector device for interconnecting circuit substrates that connects the first and second circuit substrates having substantially the same pitch for electrodes.

In still another connector device for interconnecting circuit substrates according to the present invention, a columnar connecting element is used instead of a rectangular parallelepiped connecting element. The columnar connecting element includes a columnar insulating base having a cylindrical peripheral surface and two opposed faces, and a plurality of annular electrically conducting paths that are juxtaposed on the cylindrical peripheral surface of the insulating base at a given insulating interval in a direction where the two opposed faces are arranged so that a pitch for electrically conducting paths of the plurality of electrically conducting paths may be substantially equal to a pitch for electrodes. Other configuration aspects are similar to those of the above-mentioned connector device for interconnecting circuit substrates that connects the first and second circuit substrates having substantially an equal pitch for electrodes.

The connector device for interconnecting circuit substrates configured in this manner makes it possible to obtain effects similar to those of the foregoing connector device for interconnecting circuit substrates that connects the first and second circuit substrates having substantially an equal pitch for electrodes by using a columnar connecting element instead of a rectangular parallelepiped connecting element.

If the connector housing comprises a housing body including a first receiving chamber which receives the connecting element with the one face of the connecting element exposed, a second receiving chamber that communicates with the first receiving chamber and receives the substrate portion where the plurality of electrodes are disposed, and an inserting opening through which the substrate portion is inserted into the second receiving chamber from outside, and a pushing means that is received in the second receiving chamber and pushes the substrate portion against the connecting element, positioning of the connecting element with respect to the first circuit substrate, positioning of the second circuit substrate with respect to the connecting element, and positioning of the pushing means that pushes the substrate portion against the connecting element can be performed easily by means of the connector housing.

If the pushing means is configured to push the substrate portion against the connecting element by means of spring force or elastic force, a force for pushing the substrate portion against the rectangular parallelepiped connecting element is obtained easily.

Another type of connector device for interconnecting circuit substrates includes a male connector member and a female connector member. The male connector member includes a first connecting element having a plurality of first electrically conducting paths that are disposed at a pitch for electrically conducting paths substantially equal to a pitch for electrodes on the circuit substrate and that are connected to the plurality of first connecting electrodes. The female connector member includes a second connecting element having a plurality of second electrically conducting paths that are disposed at a pitch for electrically conducting paths substantially equal to the pitch for electrodes on the circuit substrate and that are connected to the plurality of second connecting electrodes. The male connector member and the female connector member are configured so that, when the male connector member is fitted into the female connector member, a part of the plurality of first electrically conducting paths of the first connecting element and a part of the plurality of second electrically conducting paths of the second connecting element may be in contact with each other. The first connecting element includes a rectangular parallelepiped insulating base having four continuous faces and two opposed faces and the plurality of first electrically conducting paths that are juxtaposed on at least two continuous faces of the four continuous faces of the insulating base at a given insulating interval in a direction where the two opposed faces are arranged. A part of the plurality of first electrically conducting paths disposed on one of the at least two continuous faces are connected to the first connecting electrodes. The male connector member is configured so that a part of the plurality of first electrically conducting paths disposed on the other of the two continuous faces of the insulating base of the first connecting element may constitute a plurality of first contact portions that are in contact with the plurality of second electrically conducting paths of the female connector member. The second connecting element includes a rectangular parallelepiped insulating base having four continuous faces and two opposed faces and the plurality of second electrically conducting paths that are juxtaposed on at least two continuous faces of the four continuous faces of the insulating base at a given insulating interval in a direction where the two opposed faces are arranged. A part of the plurality of second electrically conducting paths disposed on one of the two continuous faces are connected to the plurality of second connecting electrodes. The female connector member is configured so that a part of the plurality of second electrically conducting paths disposed on the other of the two continuous faces of the insulating base of the second connecting element may constitute a plurality of second contact portions that are in contact with the plurality of first contact portions of the male connector member. The plurality of first contact portions are in contact with the plurality of second contact portions with the male connector member being fitted into the female connector member.

In the connector device for interconnecting circuit substrates configured in this manner, since interconnection is made by fitting the male connector member into the female connector member, a part of the plurality of first electrically conducting paths of the first connecting element included in the male connector member and a part of the plurality of second electrically conducting paths of the second connecting element included in the female connector member are positioned relative to each other to be in contact with each other. The first connecting element of the male connector member includes a rectangular parallelepiped insulating base having four continuous faces and two opposed faces and the plurality of first electrically conducting paths that are juxtaposed on at least two continuous faces of the four continuous faces of the insulating base at a given insulating interval in a direction where the two opposed faces are arranged, and the second connecting element of the female connector member includes a rectangular parallelepiped insulating base having four continuous faces and two opposed faces and the plurality of second electrically conducting paths that are juxtaposed on at least two continuous faces of the four continuous faces of the insulating base at a given insulating interval in a direction where the two opposed faces are arranged. For this reason, the pitch for electrically conducting paths of the plurality of electrically conducting paths disposed on those rectangular parallelepiped insulating bases can be defined substantially equal to the pitch for electrodes on circuit substrates with ease. Accordingly, the pitch for electrically conducting paths on the surface of the insulating base can easily be aligned with the pitch for electrodes on the side of the circuit substrate. Since the conducting paths are not zigzag aligned or staggered on the insulating base, the pitch for electrically conducting paths on the surface of the insulating base is reduced. As a result, space can be saved in a direction where the electrically conducting paths are arranged and mounting dimension can also be reduced. Accordingly, miniaturization of connector devices can be thus realized easily according to the present invention.

In the connector device for interconnecting circuit substrates that includes a male connector member and a female connector member, the female connector member may include a second connecting element having a plurality of second electrically conducting paths and a third connecting element having a plurality of third electrically conducting paths. The plurality of second electrically conducting paths are disposed at a pitch for electrically conducting paths substantially equal to a pitch for electrodes and are connected to the plurality of second connecting electrodes, and the plurality of third electrically conducting paths are disposed at a pitch for electrically conducting paths substantially equal to the pitch for electrodes and are connected to the plurality of second connecting electrodes. The male connector member and the female connector member are configured so that, when the male connector member is fitted into the female connector member, a part of the plurality of first electrically conducting paths of the first connecting element may be in contact with a part of the plurality of second electrically conducting paths of the second connecting element and a part of the plurality of third electrically conducting paths of the third connecting element. The first connecting element of the male connector member includes a rectangular parallelepiped insulating base having four continuous faces and two opposed faces and the plurality of first electrically conducting paths that are juxtaposed on at least three continuous faces of the four continuous faces of the insulating base at a given insulating interval in a direction where the two opposed faces are arranged. A part of the plurality of first electrically conducting paths disposed on a middle face of the at least three continuous faces are connected to the first connecting electrodes on the first circuit substrate. The male connector member is configured so that portions of the plurality of first electrically conducting paths disposed on the other two of the three continuous faces of the insulating base of the first connecting element may constitute a plurality of first and second contact portions that are in contact with the plurality of second electrically conducting paths of the female connector member respectively. The second connecting element includes a rectangular parallelepiped insulating base having four continuous faces and two opposed faces, and the plurality of second electrically conducting paths that are juxtaposed on at least two continuous faces of the four continuous faces of the insulating base at a given insulating interval in a direction where the two opposed faces are arranged. A part of the plurality of second electrically conducting paths disposed on one of the two continuous faces are connected to a part of the plurality of second connecting electrodes on the second circuit substrate. The third connecting element includes a rectangular parallelepiped insulating base having four continuous faces and two opposed faces, and the plurality of third electrically conducting paths that are juxtaposed on at least two continuous faces of the four continuous faces of the insulating base at a given insulating interval in a direction where the two opposed faces are arranged. A part of the plurality of third electrically conducting paths disposed on one of the two continuous faces are connected to a part of the plurality of second connecting electrodes on the second circuit substrate. The female connector member is configured so that a part of the plurality of second electrically conducting paths disposed on the other of the two continuous faces of the insulating base of the second connecting element and a part of the plurality of third electrically conducting paths disposed on the other of the two continuous faces of the insulating base of the third connecting element may constitute a plurality of third and fourth contact portions that are in contact with the plurality of first and second contact portions of the male connector member. The plurality of first and second contact portions are in contact with the plurality of third and fourth contact portions respectively with the male connector member being fitted into the female connector member.

In the connector device for interconnecting circuit substrates configured in this manner, a part of the plurality of first electrically conducting paths of the first connecting element are in contact with a part of the plurality of second electrically conducting paths of the second connecting element and a part of the plurality of third electrically conducting paths of the third connecting element by fitting the first connecting element of the male connector member into a space between the second and third connecting elements of the female connector member. Accordingly, when the first connecting element is fitted into the space between the second and third connecting elements, the plurality of first connecting electrodes that are disposed on the first circuit substrate and connected to the first connecting element can be electrically connected to the plurality of second connecting electrodes that are disposed on the second circuit substrate and connected to the second and third connecting elements. Electrical interconnection can be made between the plurality of first connecting electrodes juxtaposed on the first circuit substrate and the plurality of second connecting electrodes juxtaposed on the second circuit substrate by providing the plurality of first electrically conducting paths of the first connecting element on the four continuous faces of the insulating base, and then dividing them into two on two opposed faces of the four continuous faces, and juxtaposing on the first circuit substrate the plurality of first connecting electrodes that are connected to the male connector member such that the first connecting electrodes are opposed to the first electrically conducting paths, and juxtaposing on the second circuit substrate the plurality of second connecting electrodes that are connected to the female connector member such that the second connecting electrodes are opposed to the second electrically conducting paths. Other effects obtained from this configuration are similar to those of the above-mentioned connector device for interconnecting circuit substrates including the male connector member provided with the first connecting element and the female connector member provided with the second connecting element.

BEST MODE FOR CARRYING OUT THE INVENTION

Hereinafter, the best mode for carrying out the invention will be described in detail with reference to the drawings.

Figure 1:
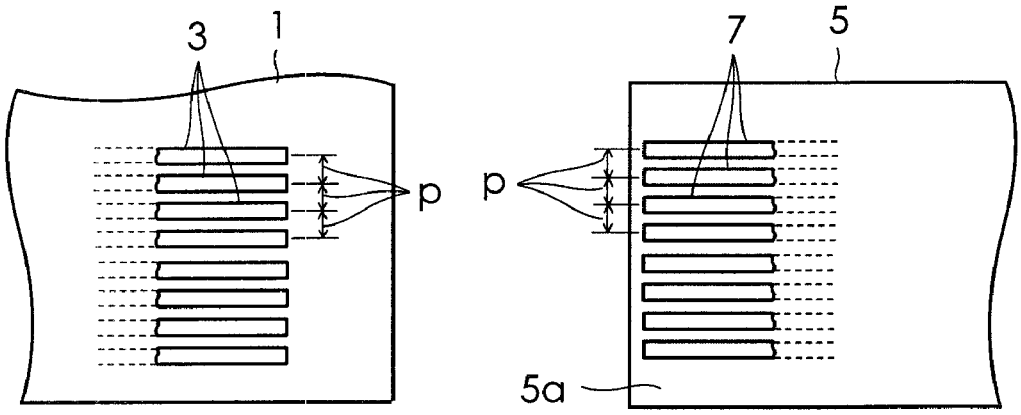
FIG. 1 is a partial plan view of first and second circuit substrates to be connected to each other using a connector device for interconnecting circuit substrates according to a first embodiment of the present invention.
Figure 2:
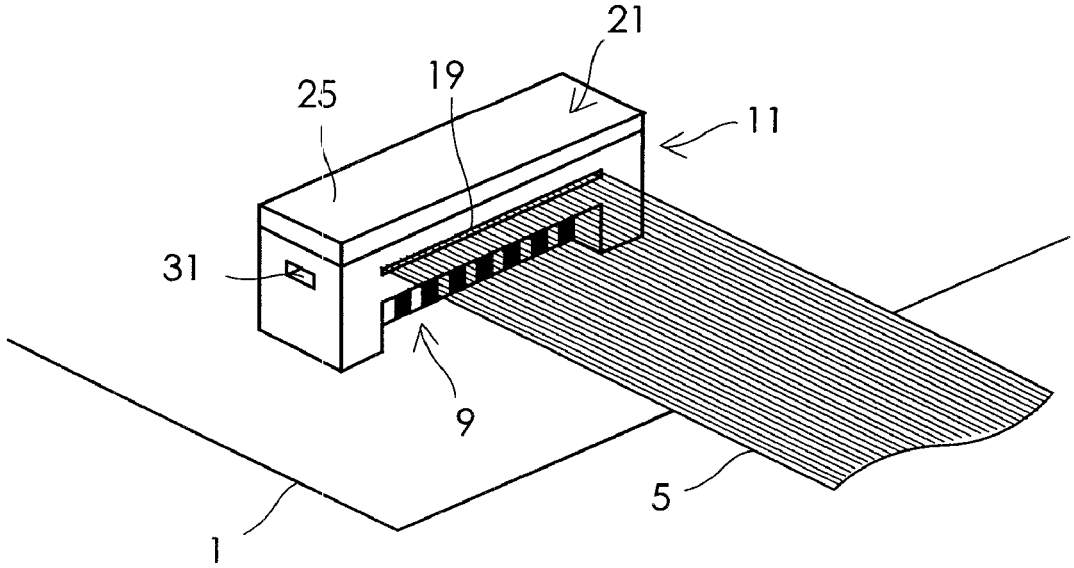
FIG. 2 is a perspective view of the connector device for interconnecting circuit substrates according to the first embodiment.
Figure 3A:
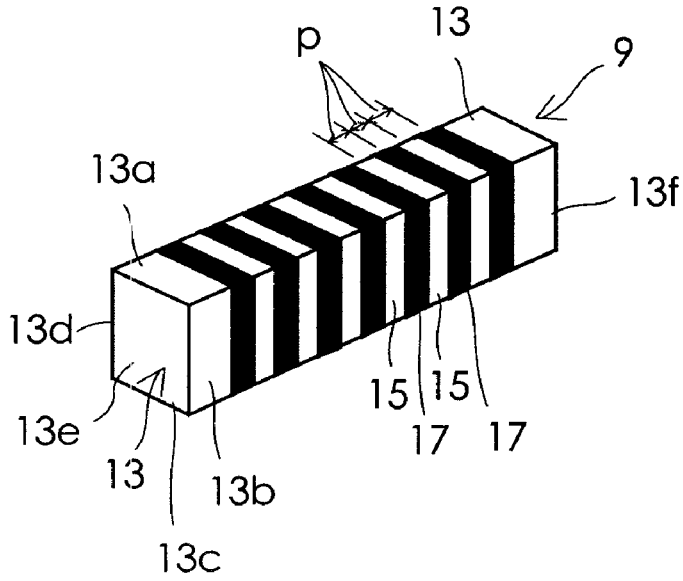
FIG. 3A is a perspective view of a rectangular parallelepiped connecting element used in the first embodiment.
Figure 3B:
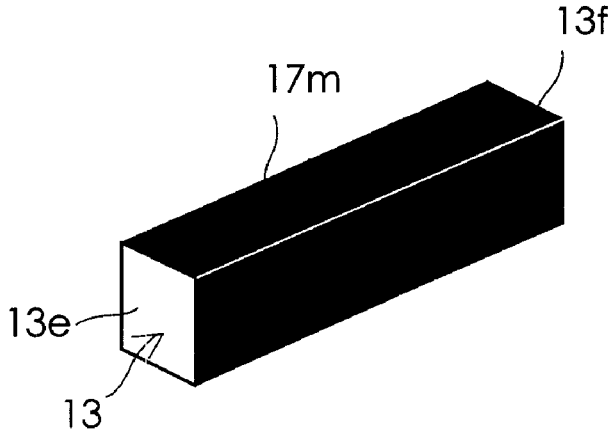
FIG. 3B is a perspective view of the rectangular parallelepiped connecting element of FIG. 3A with a plurality of electrically conducting paths not yet being formed thereon.
Figure 4A:
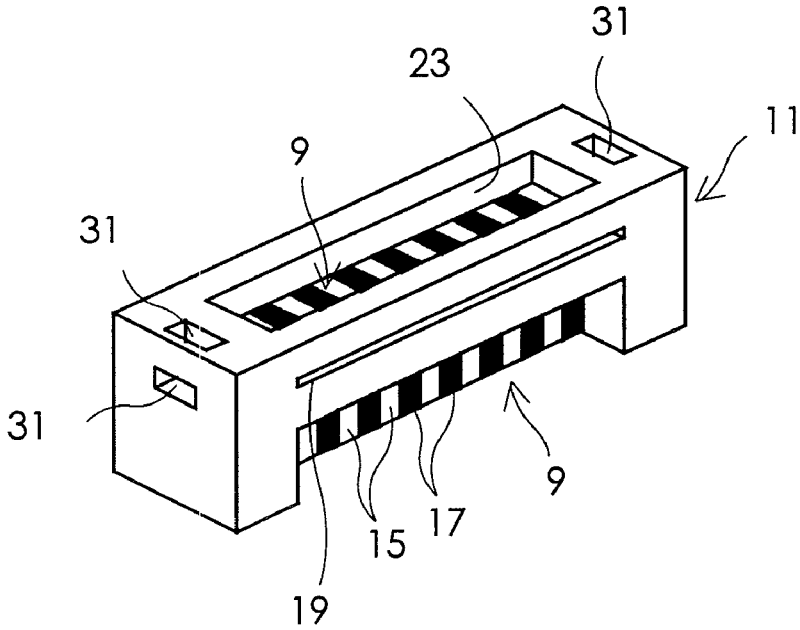
FIG. 4A is a perspective view showing the rectangular parallelepiped connecting element is received in a connector housing used in the first embodiment.
Figure 4B:
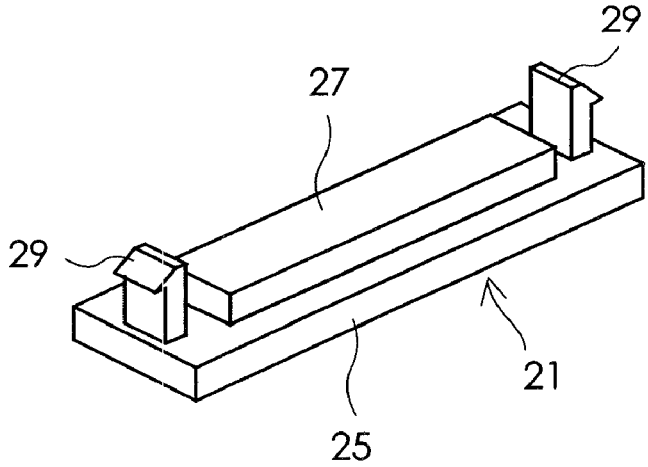
FIG. 4B is a perspective view of a pushing member that is fitted into an opening portion of the connector housing shown in FIG. 4A.
Figure 5:
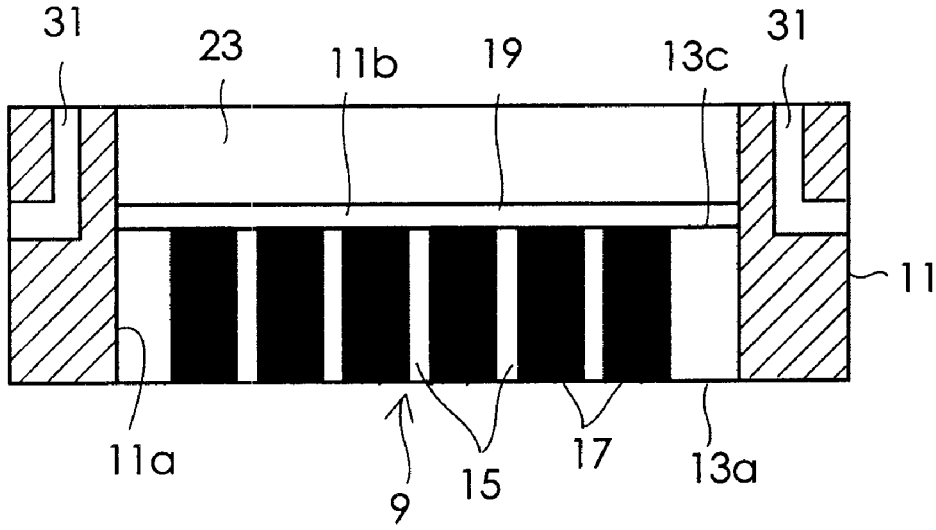
FIG. 5 is a vertical sectional view of the connector housing with the rectangular parallelepiped connecting element received therein according to the first embodiment.

FIGS. 1 to 5 show a first embodiment of a connector device for interconnecting circuit substrates according to the present invention. Here, FIG. 1 is a partial plan view of first and second circuit substrates to be connected each other using the connector device for interconnecting circuit substrates of the present embodiment. FIG. 2 is a perspective view of a connector device for interconnecting circuit substrates of the present embodiment. FIG. 3A is a perspective view of a rectangular parallelepiped connecting element used in the present embodiment, and FIG. 3B is a perspective view a rectangular parallelepiped connecting element of FIG. 3A in which a plurality of electrically conducting paths have not been formed yet. FIG. 4A is a perspective view of a connector housing with the rectangular parallelepiped connecting element received therein used in the present embodiment, and FIG. 4B is a perspective view of a pushing member that is fitted into an opening portion of the connector housing shown in FIG. 4A. FIG. 5 is a vertical sectional view of the connector housing with the rectangular parallelepiped connecting element received therein.

The connector device for interconnecting circuit substrates of the present embodiment is used to electrically connect a plurality of first connecting electrodes 3 disposed on a first circuit substrate 1 and a plurality of second connecting electrodes 7 disposed on a second circuit substrate 5 as shown in FIG. 1. The first circuit substrate 1 includes the plurality of first connecting electrodes 3 juxtaposed on a surface thereof at a pitch for electrodes P of 0.2 mm or less. The second circuit substrate 5 includes the plurality of second connecting electrodes 7 juxtaposed on a surface thereof at a pitch for electrodes, p of 0.2 mm or less. In the present embodiment, the pitch for electrodes p between the first connecting electrodes 3 juxtaposed on the first circuit substrate 1 is equal to the pitch p for electrodes between the second connecting electrodes 7 juxtaposed on the second circuit substrate 5. The second circuit substrate 5 is flexible and narrow in width. Though it is preferred that the pitch p for electrodes is 0.2 mm or less when implementing the present invention, the present invention is also technically applicable to the pitch for electrodes of more than 0.2 mm.

The connector device for interconnecting circuit substrates of the present embodiment uses a rectangular parallelepiped connecting element 9 shown in FIG. 3A and a connector housing 11 shown in FIGS. 2 and 4A.

The rectangular parallelepiped connecting element 9 includes a rectangular parallelepiped insulating base 13 made of ceramic. The insulating base 13 includes four continuous faces 13*a* to 13*d* and two opposed faces 13*e* and 13*f*. The rectangular parallelepiped connecting element 9 further includes a plurality of electrically conducting paths 17 juxtaposed on at least three continuous faces 13*a* to 13*c* of the four continuous faces 13*a* to 13*d* of the insulating base 13 at a given insulating interval 15 in a direction where the two opposed faces 13*e* and 13*f* are arranged. In the present embodiment, the plurality of electrically conducting paths 17 are juxtaposed on the four continuous faces 13*a* to 13*d* at a given insulating interval 15 in a direction where the two opposed faces 13*e* and 13*f* are arranged. A pitch p for electrically conducting paths P between the plurality of electrically conducting paths 17 is substantially equal to the pitch p for electrodes of the circuit substrates 1 and 5.

Such rectangular parallelepiped connecting element 9 is formed by covering all over the four continuous faces 13*a* to 13*d* of the insulating base 13 with a conductive portion 17*m* made of a highly conductive material such as gold, silver, copper, an alloy of copper and nickel, and an alloy of gold and silver by means of printing, plating, sputtering or the like, and removing a part of the conductive portion 17*m* with laser etc. in a circumferential direction so that the plurality of electrically conducting paths 17 may be formed at the given insulating interval 15 in a direction where the two opposed faces 13*e* and 13*f* are arranged. For example, the insulating interval 15 may be defined to be 20 μm in width, and the electrically conducting path 17 of 80 μm in width may be formed with laser etc. at a pitch 0.1 mm. The rectangular parallelepiped connecting element 9 as shown in FIG. 3A is thus completed. A pitch of 0.1 mm or less may be applicable when forming the electrically conducting paths 17 of less than 80 μm in width.

The connector housing 11 is made of a liquid crystal polymer and includes a first receiving chamber 11*a* that receives the rectangular parallelepiped connecting element 9 with one face thereof 13*a* exposed, a second receiving chamber 11*b* that communicates with the first receiving chamber 11*a* and receives a substrate portion 5*a*, in which the plurality of second connecting electrodes 7 are disposed, of the second circuit substrate 5, and an inserting opening 19 that inserts the substrate portion 5*a* into the second receiving chamber 11*b* from outside.

The connector housing 11 is mounted to the first circuit substrate 1 with the rectangular parallelepiped connecting element 9 positioned and received in the first receiving chamber 11*a*. The connector housing 11 is mounted to the first circuit substrate 1. For example, the bottom thereof may be glued with an adhesive at the four corners thereof, or by providing a protruding hook at each of the four corners thereof and letting the hooks pass through four through-holes provided on the first circuit substrate 1 to be engaged on the rear face of the substrate. When the connector housing 11 is mounted to the circuit substrate 1, the electrically conducting paths 17 formed on the rectangular parallelepiped connecting element 9 that is received in the connector housing 11 are aligned with the plurality of first connecting electrodes 3 on the first circuit substrate 1 and pushed into contact with the first connecting electrodes, or the electrically conducting paths 17 formed on the rectangular parallelepiped connecting element 9 are aligned and glued to the plurality of first connecting electrodes 3 on the first circuit substrate 1 with an electrically conductive adhesive.

The connector housing 11 is configured to allow a part of the plurality of electrically conducting paths 17 disposed on one face 13*a* of two opposed faces 13*a* and 13*c* of the three continuous faces 13*a* to 13*c* of the received rectangular parallelepiped connecting element 9 to be electrically connected to the plurality of first connecting electrodes 3 that are disposed on the first circuit substrate 1. Further, the connector housing 11 is configured to receive a substrate portion 5*a* of the second circuit substrate 5 where the plurality of second connecting electrodes 7 are disposed, through an inserting opening 19 provided in the connector housing 11, and hold the substrate portion 5*a* in a position where the portion of the plurality of electrically conducting paths 17 disposed on the other face 13*c* of the two opposed faces 13*a* and 13*c* among the three continuous faces 13*a* to 13*c* of the rectangular parallelepiped connecting element 9 is opposed to the plurality of second connecting electrodes 7 disposed on the second circuit substrate 5. The longitudinal dimension of the inserting opening 19 is defined equal to the width of the second circuit substrate 5 so that the position of the second circuit substrate 5 can be determined within the connector housing 11. Further, a contact structure 21, which brings the plurality of second connecting electrodes 7 disposed on the second circuit substrate 5 into contact with the portion of the plurality of electrically conducting paths 17 disposed on the other face 13*c* of the two opposed faces 13*a* and 13*c* are provided. The contact structure 21 includes a cover member 25 and an elastic pushing member 27. The cover member 25 fixedly covers an opening portion 23 located in an upper portion of the connector housing 11, and the elastic pushing member 27 is made of rubber or the like and fixedly glued on the back face of the cover member 25 for elastically pushing the substrate portion 5*a* of the second circuit substrate 5 that is inserted into the opening portion 23 of the connector housing 11. The cover member 25 is fixed to the connector housing 11 by elastically fitting a pair of hooks 29, disposed on the back face of both ends of the cover member 25 in the longitudinal direction, into a pair of hook holes 31 that are provided on the upper face of both ends of the connector housing 11 in the longitudinal direction.

In the connector device for interconnecting circuit substrates configured in this manner, the connector housing 11 having the rectangular parallelepiped connecting element 9 received therein is fixed to the first circuit substrate 1 with the plurality of electrically conducting paths 17 of the rectangular connecting element 9 connected to the plurality of first connecting electrodes 3 of the first circuit substrate 1. In such a state, the substrate portion 5*a* of the second circuit substrate 5 is inserted into the inserting opening 19 of the connector housing 11 in which the opening portion 23 is open upward with the plurality of second connecting electrodes 7 facing downward. Since the rectangular parallelepiped connecting element 9 is positioned in the connector housing 11, and the substrate portion 5*a* of the second circuit substrate 5 is positioned in the inserting opening 19 of the connector housing 11 the plurality of second connecting electrodes 7 of the second circuit substrate 5 are aligned and overlapped with the plurality of electrically conducting paths 17 of the rectangular parallelepiped connecting element 9 respectively. Then, the cover member 25 of the contact portion 21 fixedly covers the opening portion 23 of the connector housing 11 so that the substrate portion 5*a* of the second circuit substrate 5 may be pushed closely onto the rectangular parallelepiped connecting element 9 with the elastic pushing member 27 that is typically made of rubber plate and provided on the back side of the cover member 25. In this manner, electrical connection of the plurality of second connecting electrodes 7 of the second circuit substrate 5 onto the plurality of electrically conducting paths 17 of the rectangular parallelepiped connecting element 9 is stabilized.

Figure 6:
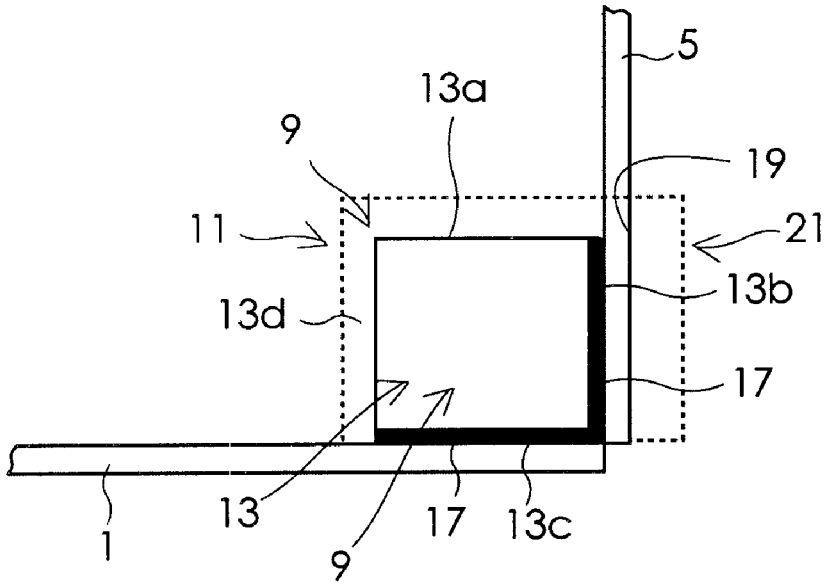
FIG. 6 is a schematic cross sectional view of a connector device for interconnecting circuit substrates according to a second embodiment of the present invention.

FIG. 6 is a schematic cross sectional view of a connector device for interconnecting circuit substrates according to a second embodiment of the present embodiment. In the second embodiment (FIG. 6), portions similar to those of the first embodiment (FIGS. 1 to 5) have their reference numerals same as the corresponding reference numerals indicated in FIG. 1, and their detailed descriptions will be omitted. In the connector device for interconnecting circuit substrates of the present embodiment, a rectangular parallelepiped connecting element 9 includes a rectangular parallelepiped ceramic insulating base 13 that includes a plurality of electrically conducting paths 17 juxtaposed on two continuous faces 13*b* and 13*c* of four continuous faces 13*a* to 13*d* at a given interval as described above. A plurality of first connecting electrodes 3 disposed on the first circuit substrate 1 are glued to the plurality of electrically conducting paths 17 provided on the face 13*c* of the insulating base 13 with an electrically conductive adhesive as described above. The rectangular parallelepiped connecting element 9 is received in a connector housing 11 as described above. An inserting opening 19 is formed in the connector housing 11 in a direction parallel to the plurality of electrically conducting paths 17 disposed on the face 13*b* of the insulating base 13 of the rectangular parallelepiped connecting element 9. A substrate portion 5*a* of a second circuit substrate 5 where a plurality of connecting electrodes are disposed is inserted into the insertion opening 19, and the plurality of electrically conducting paths 17 of the rectangular parallelepiped connecting element 9 and the plurality of second connecting electrodes 7 of the second circuit substrate 5 are aligned and overlapped with each other, and then pushed to be in electrically conductive contact with each other with a contact structure 21 as described above.

Such connector device for interconnecting circuit substrates of a sort where the first and second circuit substrates 1 and 2 are arranged orthogonally can have the same effect as embodiment 1.

Figure 7:
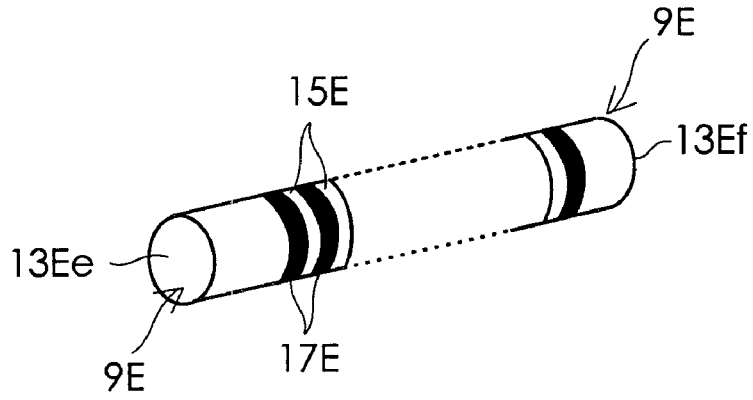
FIG. 7 is a perspective view of a columnar connecting element used in a connector device for interconnecting circuit substrates according to a third embodiment of the present invention.

FIG. 7 is a perspective view of a columnar connecting element used in a connector device for interconnecting circuit substrates according to a third embodiment of the present invention. A columnar connecting element 9E includes a plurality of electrically conducting paths 17E juxtaposed thereon at a given insulating interval 15E in a direction where two opposed faces 13Ee and 13Ef of the insulating base 13E are arranged.

Such columnar connecting element 9E can be applied to the connector device for interconnecting circuit substrates of the sort shown in FIGS. 2 and 4A, 4B, being received in the connector housing 11 instead of the rectangular parallelepiped connecting element 9.

Such columnar connecting element 9E can be applied to the connector, device for interconnecting circuit substrates of the sort shown in FIG. 6, being received in the connector housing 11 instead of the rectangular parallelepiped connecting element 9.

Figure 8:
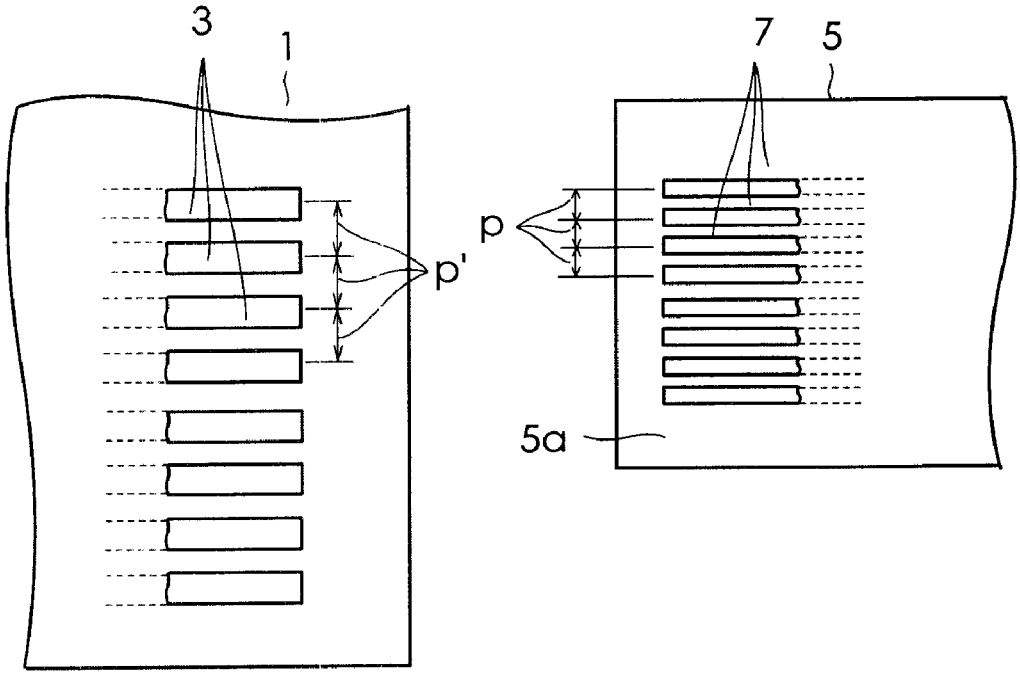
FIG. 8 is a partial plan view of first and second circuit substrates to be connected to each other using a connector device for interconnecting circuit substrates according to a fourth embodiment of the present invention.
Figure 9:
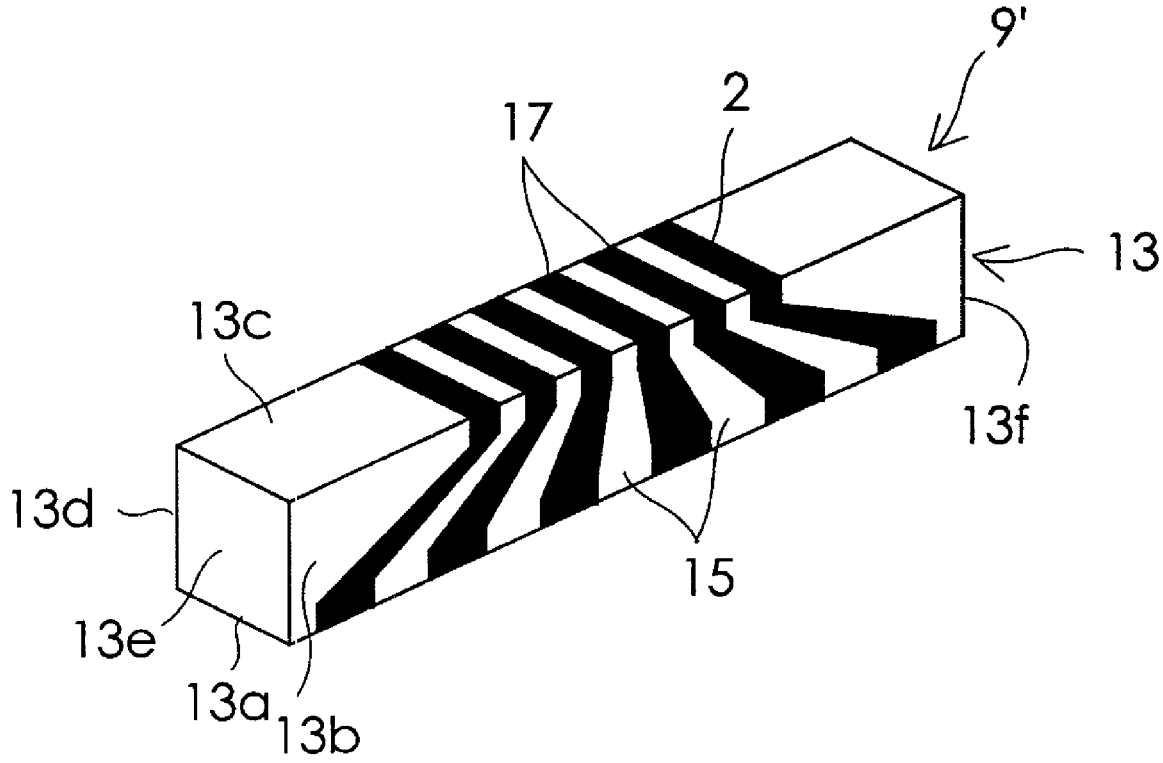
FIG. 9 is a perspective view of a rectangular parallelepiped connecting element used in the connector device for interconnecting circuit substrates of the fourth embodiment.
Figure 10A:
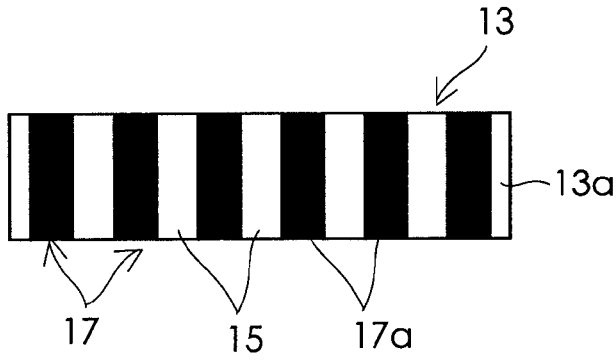
FIGS. 10A to 10C show electrically conducting paths are formed on each of three continuous faces of the rectangular parallelepiped connecting element of the fourth embodiment.
Figure 10B:
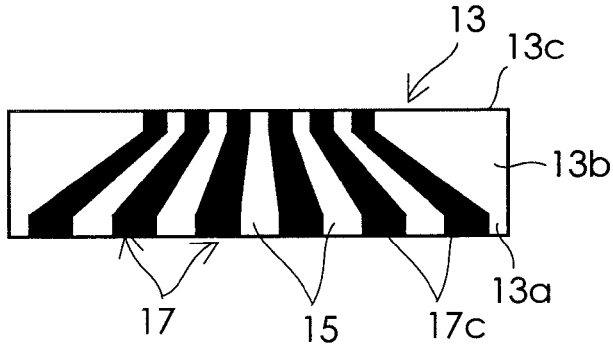
Figure 10C:
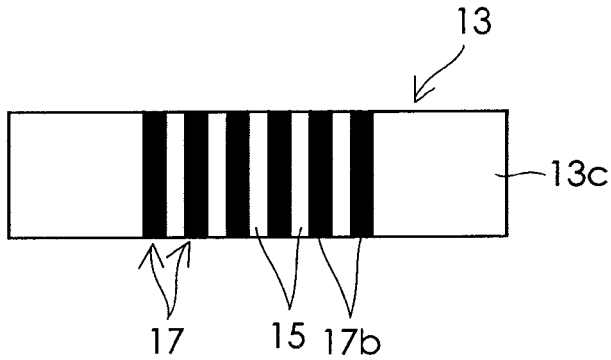

FIGS. 8 to 10 show a connector device for interconnecting circuit substrates according to a fourth embodiment of the present invention. Here, FIG. 8 is a partial plan view of first and second circuit substrates to be connected to each other using the connector device for interconnecting circuit substrates according to the fourth embodiment of the present embodiment. FIG. 9 is a perspective view of a rectangular parallelepiped connecting element used in the connector device for interconnecting circuit substrates of the present embodiment. FIGS. 10A to 10C show the rectangular parallelepiped connecting element in which electrically conducting paths are disposed on three continuous faces of the rectangular parallelepiped connecting element according to the fourth embodiment. In the fourth embodiment (FIGS. 8 to 10), portions similar to those of the first embodiment (FIGS. 1 to 5) have their reference numerals same as the corresponding reference numerals indicated in the first embodiment, and their detailed descriptions will be omitted.

In the connector device for interconnecting circuit substrates of the present embodiment, a plurality of first connecting electrodes 3 are juxtaposed on a surface of the first circuit substrate 1 at a first pitch p' for electrodes of 0.2 mm or less. A plurality of second connecting electrodes 7 are juxtaposed on a surface of the second circuit substrate 2 at a second pitch for electrodes p of 0.2 mm or less, which is different from the first pitch p' for electrodes. In the present embodiment, the first pitch p' for electrodes of the plurality of connecting electrodes 3 disposed on the first circuit substrate 1 is larger than the second pitch p for electrodes of the plurality of second connecting electrodes 7 installed on the second circuit substrate 5. Here, the first pitch p' for electrodes is defined to be 0.4 mm and the second pitch for electrodes p to be 0.2 mm, different from 0.4 mm. The first and second pitches p' and P for electrodes are not limited to those. For example, the first pitch for electrodes p' may be set to 0.35 mm and the second pitch for electrodes p may be set to 0.15 mm.

The connector device for interconnecting circuit substrates of the present embodiment includes a rectangular parallelepiped connecting element 9' and a connector housing 11, nor shown, configured similarly to the above-described first embodiment.

The rectangular parallelepiped connecting element 9' includes a rectangular parallelepiped ceramic insulating base 13 having four continuous faces 13*a* to 13*d* and two opposed faces 13*e* and 13*f*, and a plurality of electrically conducting paths 17 that are juxtaposed on at least three continuous faces 13*a* to 13*c* of the four continuous faces 13*a* to 13*d* of the insulating base 13 at insulating intervals in a direction where the two opposed faces 13*e* and 13*f* are arranged. The plurality of electrically conducting paths 17 include a plurality of first electrically conducting path portions 17*a* disposed on one face 13*a* of two opposed faces 13*a* and 13*c* of the three continuous faces 13*a* to 13*c* at a first pitch p' for electrically conducting paths equal to the first pitch for electrodes, a plurality of second electrically conducting path portions 17*b* disposed on the other face 13*c* of the two opposed faces 13*a* and 13*c* of the three continuous faces 13*a* to 13*c* at a second pitch p for electrically conducting paths equal to the second pitch p for electrodes, and a plurality of third electrically conducting path portions 17*c* disposed on the rest face 13*b* of the three continuous faces 13*a* to 13*c* that connects the plurality of first electrically conducting path portions 17*a* and the plurality of second electrically conducting path portions 17*b* respectively for pitch conversion. Other portions are configured similarly to those of the connector device for interconnecting circuit substrates in which the first circuit substrate 1 and the second circuit substrate 5 having the same pitch for electrodes are connected to each other.

In the connector device for interconnecting circuit substrates configured in this manner, the plurality of first connecting electrodes 3 of the first circuit substrate 1 and the plurality of second connecting electrodes 7 of the second circuit substrate 5 are electrically connected as with the connector device for interconnecting circuit substrates according to the first embodiment. Here in the fourth embodiment, even though the pitch for electrodes of the plurality of first connecting electrodes 3 on the first circuit substrate 1 is different from that of the plurality of second connecting electrodes 7 on the second circuit substrate 5, it is possible to electrically connect the first and second circuit substrates 1 and 5 having different pitches for electrodes, because the plurality of electrically conducting paths 17 includes the plurality of first electrically conducting path portions 17*a* formed on one face 13*a* of two opposed faces 13*a* and 13*c* of the three continuous faces 13*a* to 13*c* of the rectangular parallelepiped connecting element 9' at a first pitch p' for electrically conducting paths equal to the first pitch p' for electrodes, the plurality of second electrically conducting path portions 17*b* formed on the other face 13*c* of the two opposed faces 13*a* and 13*c* of the three continuous faces 13*a* to 13*c* at a second pitch for electrically conducting paths p equal to the second pitch p for electrodes, and a plurality of third electrically conducting path portions 17*c* formed on the rest face 13*b* of the three continuous faces 13*a* to 13*c* that connects the plurality of first electrically conducting path portions 17*a* and the plurality of second electrically conducting path portions 17*b* respectively for pitch conversion. Other effects are the same as those of the above-mentioned first embodiment.

Figure 11A:
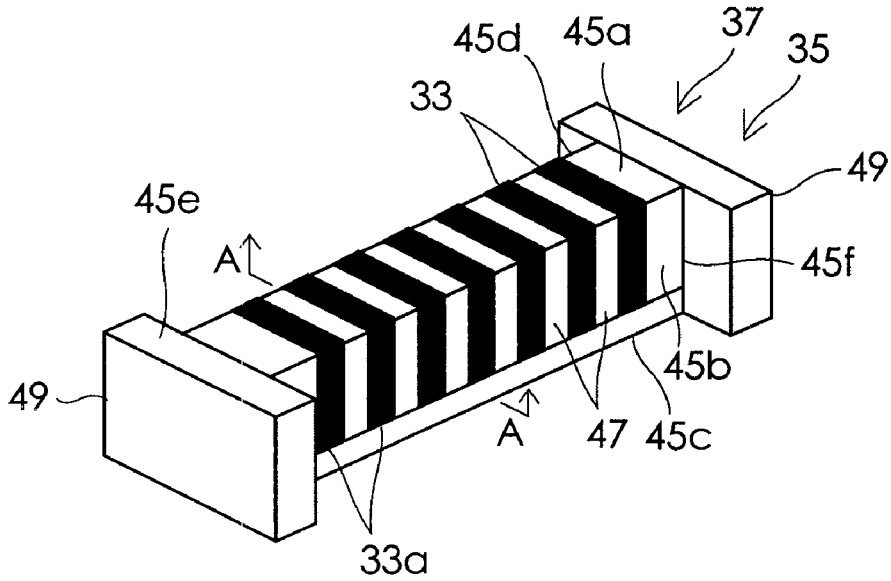
FIG. 11A is a perspective view of a male connector member used in a connector device for interconnecting circuit substrate according to a fifth embodiment of the present invention.
Figure 11B:
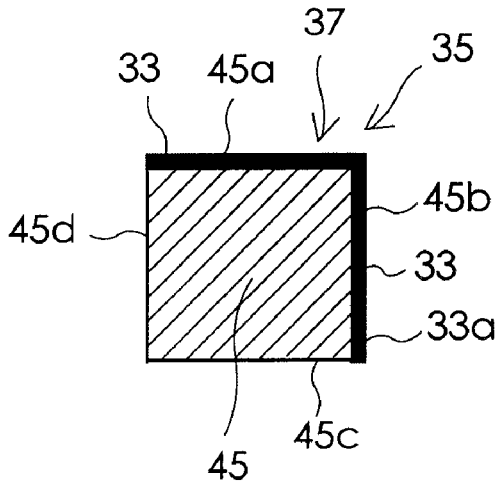
FIG. 11B is a sectional view taken along line A-A of FIG. 11A.
Figure 12A:
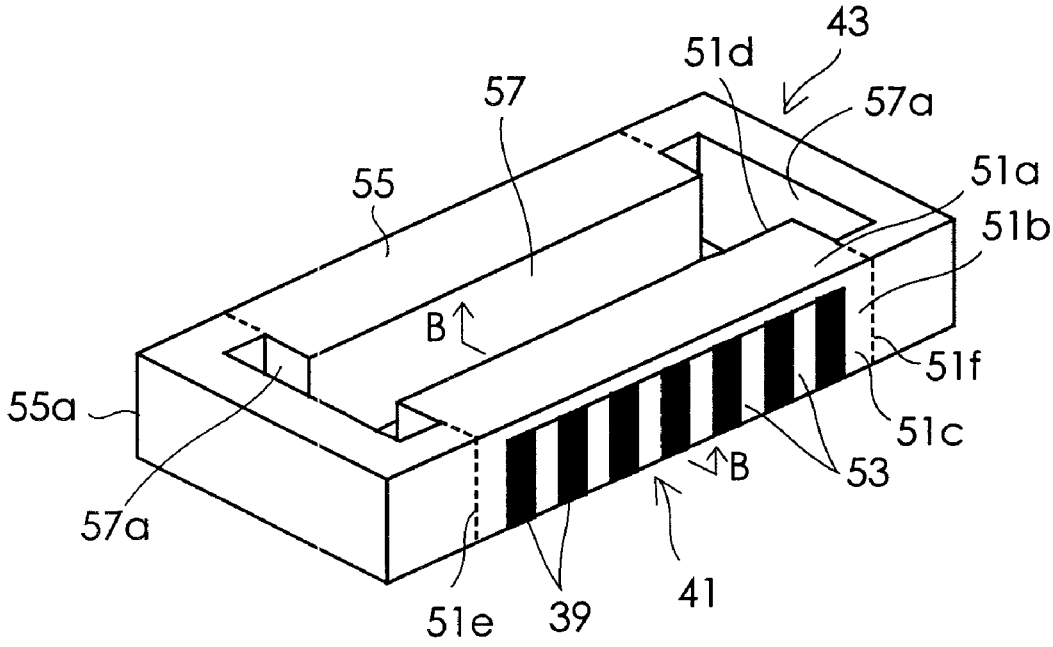
FIG. 12A is a perspective view of a female connector member used in the fifth embodiment.
Figure 12B:
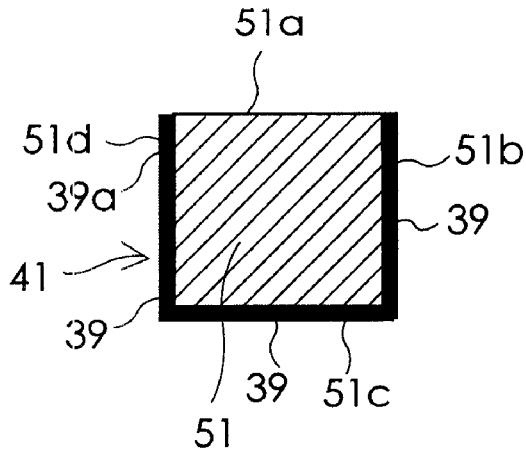
FIG. 12B is a sectional view taken along line B-B of FIG. 12A.

FIGS. 11 and 12 show a connector device for interconnecting circuit substrates according to a fifth embodiment of the present invention. Here, FIG. 11A is a perspective view of a male connector member used in the present embodiment, and FIG. 11B is a sectional view taken along line A-A of FIG. 11A. FIG. 12A is a perspective view of a female connector member used in the present embodiment, and FIG. 12B is a sectional view taken along line B-B of FIG. 12A.

The present embodiment shows another configuration of the connector device for interconnecting circuit substrates in which the plurality of first connecting electrodes 3 disposed on the first circuit substrate at a pitch for electrodes of 0.2 mm or less and the plurality of second connecting electrodes 7 disposed on the second circuit substrate 5 at a pitch for electrodes of 0.2 mm or less, both of which are used in the above-mentioned first embodiment, are electrically connected.

The connector device for interconnecting circuit substrates of this embodiment comprises a male connector member 37 and a female connector member 43. The male connector member 37 includes a first connecting element 35 having a plurality of first electrically conducting paths 33, which are disposed at a pitch p for electrically conducting paths substantially equal to the pitch p for electrodes, to be connected to the plurality of first connecting electrodes 3 as shown in FIGS. 11A and 11B. The female connector member 43 includes a second connecting element 41 having a plurality of second electrically conducting paths 39, which are disposed at a pitch p for electrically conducting paths substantially equal to the pitch p for electrodes to be connected to the plurality of second connecting electrodes 7 as shown in FIGS. 12A and 12B.

The male connector member 37 and the female connector member 43 are configured so that, when the male connector member 37 is fitted into the female connector member 43, a part of the plurality of first electrically conducting paths 33 of the first connecting element 35 and a part of the plurality of second electrically conducting paths 39 of the second connecting element 41 may be in contact with each other.

The first connecting element 35 includes a rectangular parallelepiped ceramic insulating base 45 having four continuous faces 45*a* to 45*d* and two opposed faces 45*e* and 45*f* and the plurality of first electrically conducting paths 33 that are juxtaposed on at least two continuous faces 45*a* and 45*b* of the four continuous faces 45*a* to 45*d* of the insulating base 45 at a given insulating interval 47 in a direction where the two opposed faces 45*e* and 45*f* are arranged. A flange portion 49 for positioning is integrally disposed on both end faces of the two opposed faces 45*e* and 45*f*.

In such first connecting element 35, a part of the plurality of first electrically conducting paths 33 disposed on the one face 45*a* of the at least two continuous faces 45*a* and 44*b* are connected to the first connecting electrodes 3 of the first circuit substrate 1 with an electrically conductive adhesive.

The male connector member 37 is configured so that a part of the plurality of first electrically conducting paths 33 disposed on the other face 45*b* of the two continuous faces 45*a* and 45*b* of the insulating base 45 of the first connecting element 35 may constitute a plurality of first contact portions 33*a* that are in contact with the plurality of second electrically conducting paths 39 of the female connector member 43.

The second connecting element 41 includes a rectangular parallelepiped insulating base 51 having four continuous faces 51*a* to 51*d* and two opposed faces 51*e* and 51*f* and the plurality of second electrically conducting paths 39 that are juxtaposed on at least three continuous faces 51*b* to 51*d* of the four continuous faces 51*a* to 51*d* of the insulating base 51 at a given insulating interval 53 in a direction where the two opposed faces 51*e* and 51*f* are arranged. Here in this example, the second electrically conducting paths 39 may be disposed on at least two continuous faces 51*c* and 51*d* of the insulating base 51.

The female connector member 43 is configured in such a manner that a connector housing 55 for receiving the male connector member 37 is formed integrally with the second connecting element 41 that is included in the connector housing 55 as a part of its peripheral wall. A first connecting element receiving chamber 57 that receives the first connecting element 35 is formed in the connector housing 55, penetrating a side face of the connector housing. The first connecting element receiving chamber 57 is configured to further receive the flange portion 49 for positioning of the male connector member 37 together with the first connecting element 35. Namely, the first connecting element receiving chamber 57 includes flange portion receiving portions 57*a* for positioning to determine the position of the male connector member 37.

Such female connector member 43 is configured to allow a part of the plurality of second electrically conducting paths 39 disposed on the one face 51*c* of the two continuous faces 51*c* and 51*d* of the second connecting element 41 to be connected to the plurality of second connecting electrodes 7 of the second circuit substrate 5 when the first connecting element 35 is fitted into the first connecting element receiving chamber 57. Accordingly, the female connector member 43 is configured so that a part of the plurality of second electrically conducting paths 39 disposed on the other face 51*d* of the two continuous faces 51*c* and 51*d* of the insulating base 51 of the second connecting element 41 may constitute a plurality of second contact portions 39*a* that are in contact with the plurality of first contact portions 33*a* of the male connector member 37.

The plurality of first contact portions 33*a* and the plurality of second contact portions 39*a* are in contact with each other with the male connector member 37 being fitted into the female connector member 43.

In the female connector member 43, a part of the plurality of second electrically conducting paths 39 disposed on the one face 51*c* of the two continuous faces 51*c* and 51*d* of the second connecting element 41 are connected to the plurality of second connecting electrodes 7 of the second circuit substrate 5 with an electrically conductive adhesive.

To allow the plurality of first contact portions 33*a* to be in contact with the plurality of second contact portions 39*a*, the insulating base 45 of the first connecting element 35 and the connector housing 55 may be made of ceramic to precisely define the configuration of the first connecting element receiving chamber 57. Alternatively, a member 55*a*, (which is connected to the insulating base 51 of the second connecting element 41 to constitutes the connector housing 55, may be made of a rubber elastic material and the first connecting element receiving chamber 57 may be formed smaller than the first connecting element 35 so that the first connecting element 35 can be pushed into the first connecting element receiving chamber 57.

In such connector device for interconnecting circuit substrates, the plurality of first electrically conducting paths 33 of the male connector member 37 are connected and fixed to the plurality of first connecting electrodes 3 of the first circuit substrate 1 as mentioned above, and the plurality of second electrically conducting paths 39 of the second connecting element 41 of the female connector member 43 are connected and fixed to the plurality of second connecting electrodes 7 of the second circuit substrate 5 as mentioned above. Then, the male connector member 37 is fitted into the first connecting element receiving chamber 57 of the female connector member 43. Thus, the plurality of first connecting electrodes 3 of the first circuit substrate 1 and the plurality of second connecting electrodes 7 of the second circuit substrate 5 are electrically connected via the plurality of first electrically conducting paths 33 of the male connector member 37 and the plurality of second electrically conducting paths 39 of the female connector member 43. Other effects obtained from this configuration are the same as those of the above-mentioned first embodiment.

Figure 13:
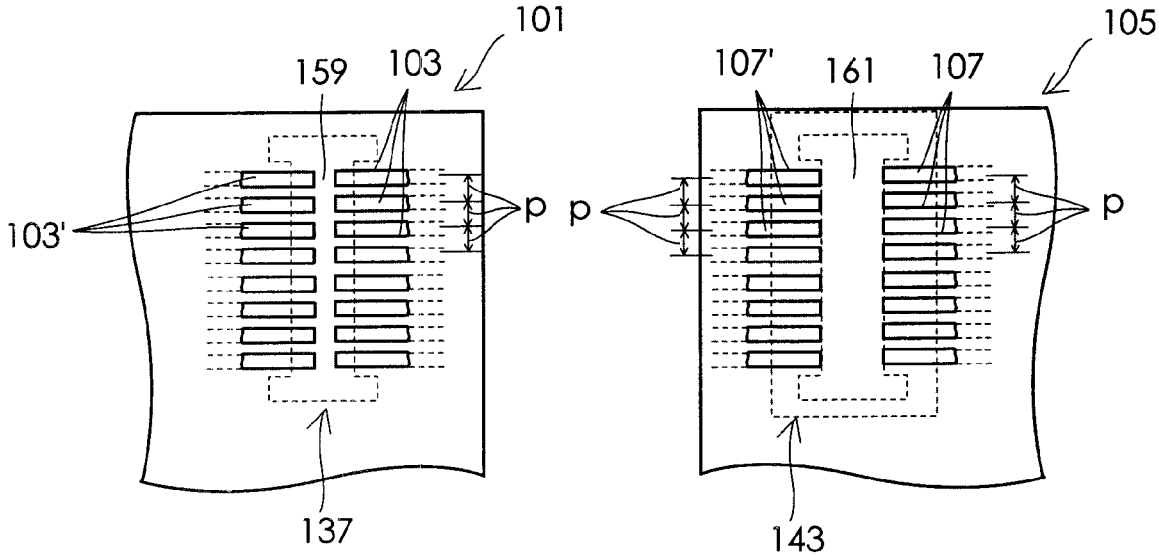
FIG. 13 is a partial plan view of first and second circuit substrates to be connected to each other using a connector device for interconnecting circuit substrates according to a sixth embodiment of the present invention.
Figure 14A:
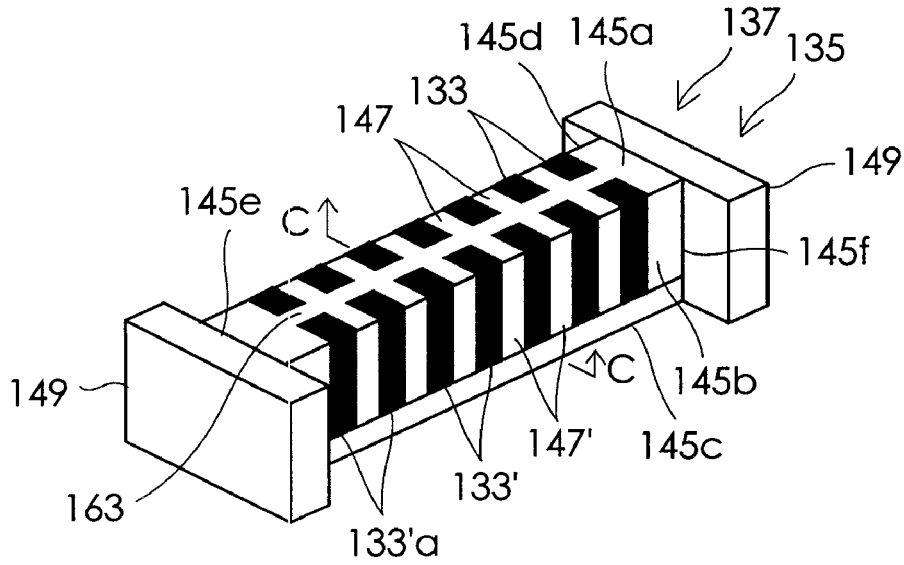
FIG. 14A is a perspective view of a male connector member used in the connector device for interconnecting circuit substrates of the sixth embodiment.
Figure 14B:
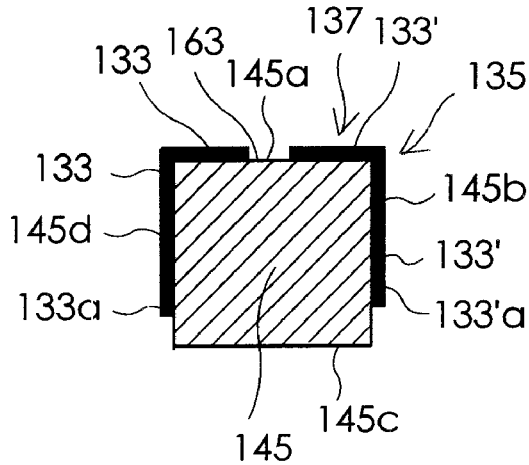
FIG. 14B is a sectional view taken along line C-C of FIG. 14A.
Figure 15A:
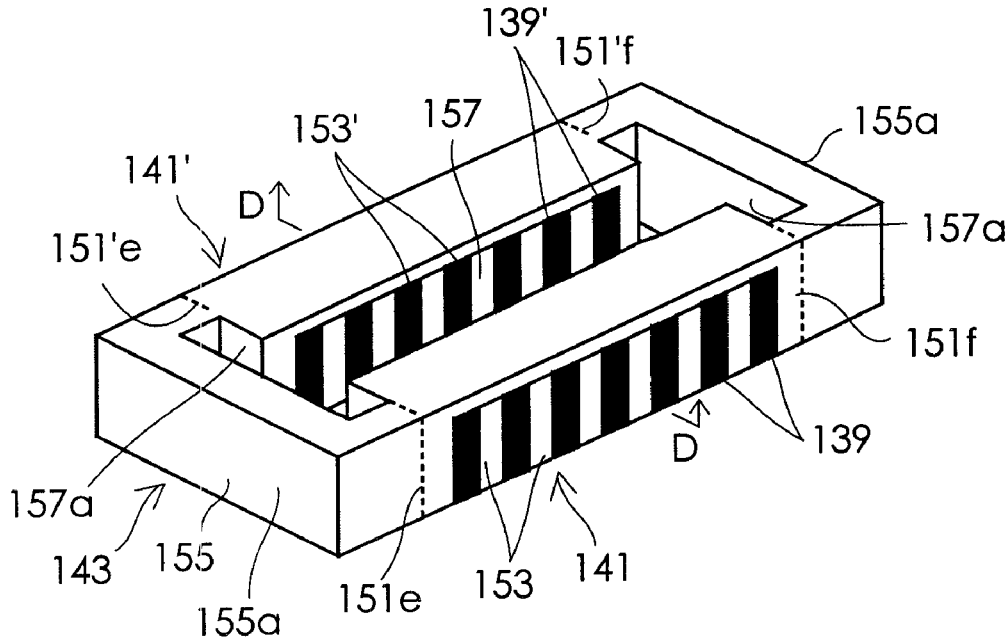
FIG. 15A is a perspective view of a female connector member used in the connector device for interconnecting circuit substrates of the sixth embodiment.
Figure 15B:
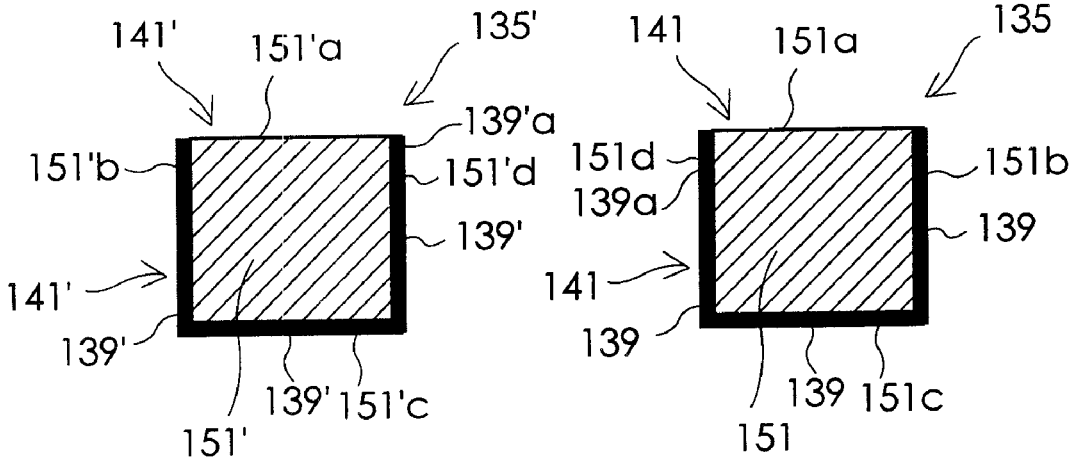
FIG. 15B is a sectional view taken along line D-D of FIG. 15A.
Figure 16:
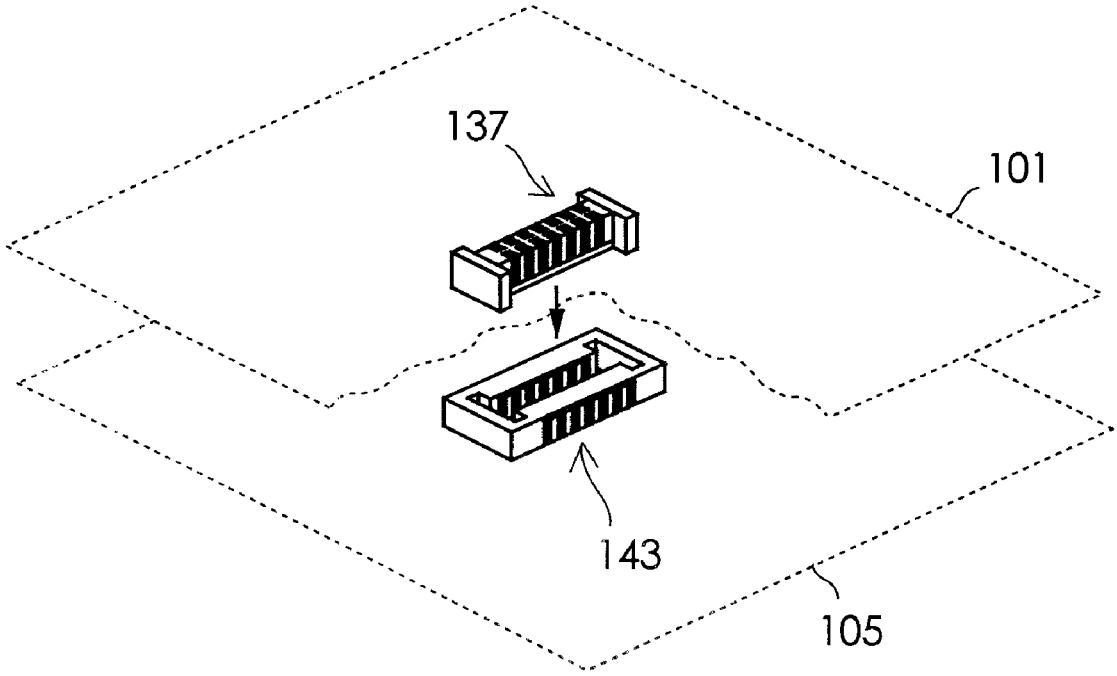
FIG. 16 is a partially-broken perspective view showing how the first circuit substrate with the male connector member mounted thereon and the second circuit substrate with female connector member mounted thereon are connected in the sixth embodiment.

FIGS. 13 to 16 show a connector device for interconnecting circuit substrates according to a sixth embodiment of the present invention. Here, FIG. 13 is a partial plan view of first and second circuit substrates to be connected to each other using the connector device for interconnecting circuit substrates according to the sixth embodiment of the present embodiment. FIG. 14A is a perspective view of a male connector member used in the connector device for interconnecting circuit substrates according to the present embodiment, and FIG. 14B is a sectional view taken along line C-C of FIG. 14A. FIG. 15A is a perspective view of a female connector member used in the connector device for interconnecting circuit substrates according to the present embodiment, and FIG. 15B is a sectional view taken along line D-D of FIG. 15A. FIG. 16 is a partially-broken perspective view showing how a first circuit substrate with the male connector member mounted thereon and a second circuit substrate with the female connector member mounted thereon are connected according to the present embodiment. In the sixth embodiment, portions similar to those of the fifth embodiment have their reference numerals calculated by adding 100 to the corresponding reference numerals indicated in the fifth embodiment, and description thereof is omitted.

A connector device for interconnecting circuit substrates according to the present embodiment is used for electrically connecting a first circuit substrate 101 and a second circuit substrate 105. A plurality of first connecting electrodes 103 and 103' are juxtaposed at a pitch p for electrodes of 0.2 mm or less on a surface of the first circuit substrate 101 and a plurality of second connecting electrodes 107 and 107' are juxtaposed at a pitch p for electrodes of 0.2 mm or less on a surface of the second circuit substrate 105, as shown in FIG. 13. The plurality of first connecting electrodes 103 and 103' are connected to two pairs of circuits, electronic equipments and so on, not shown, and the plurality of second connecting electrodes 107 and 107' are connected to another two pairs of circuits, electronic equipments and so on, not shown. The plurality of first connecting electrodes 103 and 103' are juxtaposed with a gap 159 therebetween, and the plurality of second connecting electrodes 107 and 107' are juxtaposed with a gap 161 therebetween.

As shown in FIGS. 14A and 14B, the connector device for interconnecting circuit substrates includes a male connector member 137 provided with a first connecting element 135. The first connecting element 135 includes a plurality of first electrically conducting paths 133 and 133' that are disposed at a pitch p for electrically conducting paths substantially equal to the pitch p for electrodes of the first circuit substrate 101 and connected to the plurality of first connecting electrodes 103 and 103'. The plurality of first electrically conducting paths 133 and 133' are juxtaposed to face each other at the ends thereof with a gap 163 therebetween.

As shown in FIGS. 15A and 15B, the connector device for interconnecting circuit substrates includes a female connector member 143 provided with a second connecting element 141 and a third connecting element 141'. The second connecting element 141 includes a plurality of second electrically conducting paths 139 that are disposed at a pitch p for electrically conducting paths substantially equal to the pitch p for electrodes of the second circuit substrates 105 and connected to the plurality of second connecting electrodes 107. The third connecting element 141' includes a plurality of third electrically conducting paths 139' that are disposed at a pitch p for electrically conducting paths substantially equal to the pitch p for electrodes of the second circuit substrate 105 and connected to the plurality of second connecting electrodes 107'.

The male connector member 137 and the female connector member 143 are configured so that, when the male connector member 137 is fitted into the female connector member 143, a part of the plurality of first electrically conducting paths 133 and 133' of the first connecting element 135 may be in contact with a part of the plurality of second electrically conducting paths of the second connecting element 141 and a part of the plurality of third electrically conducting paths 139' of the third connecting element 141' respectively.

The first connecting element 135 includes a rectangular parallelepiped ceramic insulating base 145 having four continuous faces 145*a* to 145*d* and two opposed faces 145*e* and 145*f*, and the plurality of first electrically conducting paths 133 and 133' that are juxtaposed on at least three continuous faces 145*d*, 145*a* and 145*b* of the four continuous faces 145*a* to 145*d* of the insulating base 145 at a given insulating interval 147 and 147' in a direction where the two opposed faces 145*e* and 145*f* are arranged. A part of the plurality of first electrically conducting paths 133 and 133' disposed on the middle face 145*a* of the at least three continuous faces 145*d*, 145*a* and 145*b* are connected to the first connecting electrodes 103 and 103' disposed on the first circuit substrate 101.

The male connector member 137 is configured so that a part of the plurality of first electrically conducting paths 133 and 133' respectively disposed on the other two faces 145*d* and 145*b* of the three continuous faces 145*d*, 145*a* and 145*b* of the insulating base 145 of the first connecting element 135 may constitute a plurality of first contact portions 133*a* and a second contact portions 133'*a* that are in contact with the plurality of second electrically conducting paths 139 and the plurality of third electrically conducting paths 139' of the female connector member 143 respectively.

The second connecting element 141 includes a rectangular parallelepiped ceramic insulating base 151 having four continuous faces 151*a* to 151*d* and two opposed faces 151*e* and 151*f*, and the plurality of second electrically conducting paths 139 that are juxtaposed on at least two continuous faces 151*c* and 151*d*, in the present embodiment, the three continuous faces 151*b*, 151*c* and 151*d* of the four continuous faces 151*a* to 151*d* of the insulating base 151 at a given insulating interval 153 in a direction where the two opposed faces 151*e* and 151*f* are arranged. A part of the plurality of second electrically conducting paths 139 disposed on one face 151*c* of the two continuous faces 151*c* and 151*d* are connected to a part of the plurality of second connecting electrodes 107 of the second circuit substrate 105.

The third connecting element 141' includes a rectangular parallelepiped ceramic insulating base 151' having four continuous faces 151'*a* to 151'*d* and two opposed faces 151'*e* and 151'*f*, and the plurality of third electrically conducting paths 139' that are juxtaposed on at least two continuous faces 151'*c* and 151'*d*, in the present embodiment, three continuous faces 151'*b*, 151'*c* and 151'*d* of the four continuous faces 151'*a* to 151'*d* of the insulating base 151', at a given insulating interval 153' in a direction where the two opposed faces 151'*e* and 151'*f* are arranged. A part of the plurality of third electrically conducting paths 139' disposed on one face 151'*c* of the two continuous faces 151'*c* and 151'*d* are connected to a part of the plurality of second connecting electrodes 107' disposed on the second circuit substrate 105.

The female connector member 143 is configured in such a manner that a connector housing 155 for receiving the male connector member 137 is formed integrally with the second connecting element 141 and the third connecting element 141', which are included in the connector housing 155 as a part of a peripheral wall thereof and arranged facing each other with a space therebetween. In the present embodiment, the connector housing 155 is formed by disposing the second connecting element 141 and the third connecting element 141' in parallel to each other with a space therebetween, and connecting the opposed ends thereof integrally with members 155*a* and 155*a*. A first connecting housing receiving chamber 157 that receives the first connecting element 135 is formed in the connector housing 155, penetrating the opposed faces of the second connecting element 141 and the third connecting element 141' that are facing each other. The first connecting element receiving chamber 157 is configured to also receive flange portions 149 and 149 for positioning of the male connector member 137. Namely, the first connecting element receiving chamber 157 includes flange portion receiving portions 157*a* and 157*a*, and the male connector member 137 is positioned by means of the flange portion receiving portions 157*a* and 157*a*.

Such female connector member 143 is configured so that, when the first connecting element 135 is fitted into the first connecting element receiving chamber 157, a part of the plurality of second electrically conducting paths 139 disposed on the one face 151*c* of the two continuous faces 151*c* and 151*d* of the second connecting element 141 may be connected to the plurality of second connecting electrodes 107 disposed on the second circuit substrate 105. Accordingly, the female connector member 143 is configured so that a part of the plurality of second electrically conducting paths 139 disposed on the other face 151*d* of the two continuous faces 151*c* and 151*d* of the insulating base 151 of the second connecting element 141 may constitute a plurality of third contact portions 139*a* that are in contact with the plurality of second contact portions 133'*a* of the male connector member 137.

The female connector member 143 is further configured so that, when the first connecting element 135 is fitted into the first connecting element receiving chamber 157, a part of the plurality of third electrically conducting paths 139' disposed on the one face 151'*c* of the two continuous faces 151'*c* and 151'*d* of the third connecting element 141' may be connected to the plurality of second connecting electrodes 107' disposed on the second circuit substrate 105. Accordingly, the female connector member 143 is configured so that a part of the plurality of third electrically conducting paths 139' disposed on the other face 151'*d* of the two continuous faces 151'*c* and 151'*d* of the insulating base 151' of the third connecting element 141' may constitute a plurality of fourth contact portions 139'*a* that are in contact with the plurality of first contact portions 133*a* of the male connector member 137.

The female connector member 143 is configured so that the part of the plurality of second electrically conducting paths 139 disposed on the other face 151*d* of the two continuous faces 151*c* and 151*d* of the insulating base 151 of the second connecting element 141, and the part of the plurality of third electrically conducting paths 139' disposed on the other face 151'*d* of the two continuous faces 151'*c* and 151'*d* of the insulating base 151' of the third connecting element 141' may constitute the plurality of third and fourth contact portions 139*a* and 139'*a* that are in contact with the first and second contact portions 133*a* and 133'*a* of the male connector member 137.

The plurality of first and second contact portions 133*a* and 133'*a* are in contact with the plurality of third and fourth contact portions 139*a* and 139'*a* with the male connector member 137 being fitted into the female connector member 143.

To allow the plurality of first and second contact portions 133*a* and 133'*a* and the plurality of third and fourth contact portions 139*a* and 139'*a* to be in contact with each other respectively, the insulating base 151 and 151' of the second and third connecting elements 141 and 141' and the members 155*a* and 155*a* of the connector housing 155 may be made of ceramic to precisely define the configuration of the first connecting element receiving chamber 157. Alternatively, the members 155*a* and 155*a*, which are connected to the insulating bases 151 and 151' of the second connecting element 141 and the third connecting element 141' to constitute the connector housing 155 may be made of a rubber elastic material, and the first connecting element receiving chamber 157 may be formed smaller than the first connecting element 135 so that the first connecting element 135 may be pushed into the first connecting element receiving chamber 157.

in the sixth embodiment, the plurality of first electrically conducting paths 133 and 133' formed on the first connecting element 135 of the male connector member 137 may be integrally formed without providing a gap 163 therebetween. Such first connecting element 135 having only the plurality of first electrically conducting paths 133 may be connected to either of a pair of circuits or two pairs of circuits of the female connector member 143.

In the embodiments of FIGS. 12 and 15, the connector housing 155 of the female connector member 143 may be made of ceramic or the like in advance, and then the second and third electrically conducting paths 139 and 139' of the second and third connecting elements 141 and 141' may be formed.

INDUSTRIAL APPLICABILITY

In the connector device for interconnecting circuit substrates according to the present invention, since a rectangular parallelepiped connecting element includes a rectangular parallelepiped insulating base having four continuous faces and two opposed faces and a plurality of electrically conducting paths that are juxtaposed at an insulating interval in a direction where the two opposed faces are arranged, the plurality of electrically conducting paths may be easily disposed on the rectangular parallelepiped insulating base at a pitch for electrically conducting paths substantially equal to a pitch for electrodes of circuit substrates. As a result, the pitch for electrically conducting paths on the surface of the insulating base may be easily aligned with the pitch for electrodes of circuit substrates. Since the conducting paths are not zigzag aligned or staggered, the pitch for electrically conducting paths on the surface of the insulating base may be reduced. As a result, a space may be saved in a direction where the electrically conducting paths are arranged and mounting dimension may also be reduced. Accordingly, miniaturization of connector devices may thus be realized easily according to the present invention. What is more, the connector device employs a connector housing mounted to the first circuit substrates with a rectangular parallelepiped connecting element received therein. The connector housing is configured to allow a plurality of electrically conducting path portions disposed on one of two opposed faces of the three continuous faces of the rectangular parallelepiped connecting element to be electrically connected to the plurality of first connecting electrodes that are disposed on the first circuit substrate, and is also configured to receive a substrate portion of the second circuit substrate where the plurality of second connecting electrodes are disposed and hold the substrate portion in a position where a plurality of electrically conducting path portions disposed on the other face of the two opposed faces of the three continuous faces of the rectangular parallelepiped connecting element is opposed to the plurality of second connecting electrodes. As a result, electric connection between the plurality of first connecting electrodes of the first circuit substrate and the plurality of second connecting electrodes of the second circuit substrate may be made easily by positioning the connector housing. Also, the plurality of second connecting electrodes of the second circuit substrate may positively be brought into contact with the plurality of electrically conducting path portions disposed on the other face of the two opposed faces of the three continuous faces of the rectangular parallelepiped connecting element.

In another type of connector device for interconnecting circuit substrates according to the present invention, since connection is made by fitting a male connector member into a female connector member, a part of the plurality of first electrically conducting paths disposed on the first connecting element of the male connector member and a part of the plurality of second electrically conducting paths disposed on the second connecting element of the female connector member are positioned to be in contact with each other. The first connecting element of the male connector member includes a rectangular parallelepiped insulating base having four continuous faces and two opposed faces and a plurality of first electrically conducting paths that are juxtaposed on at least two continuous faces of the four continuous faces of the insulating base at a given insulating interval in a direction where the two opposed faces are arranged. The second connecting element of the female connector member includes a rectangular parallelepiped insulating base having four continuous faces and two opposed faces and a plurality of second electrically conducting paths that are juxtaposed on at least two continuous faces of the four continuous faces of the insulating base at a given insulating interval in a direction where the two opposed faces are arranged. Accordingly, the pitch for electrically conducting paths of the plurality of electrically conducting paths disposed on the rectangular parallelepiped insulating bases may readily be substantially equal to the pitch for electrodes of circuit substrates. As a result, the pitch for electrically conducting paths con the surface of the insulating base may be easily aligned with the pitch for electrodes on the side of circuit substrates. Since the conducting paths are not zigzag aligned or staggered, the pitch for electrically conducting paths on the surface of the insulating base is reduced. As a result, a space may be saved in a direction where the electrically conducting paths are arranged and mounting dimension may also be reduced. Accordingly, miniaturization of connector devices may thus be realized easily according to the present invention.

The invention claimed is:

1. A connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a first pitch for electrodes, the plurality of second connecting electrodes being juxtaposed on a surface of the second circuit substrate at a second pitch for electrodes of 0.2 mm or less which is different from the first pitch for electrodes, the connector device for interconnecting circuit substrates comprising:

a rectangular parallelepiped connecting element including:

a rectangular parallelepiped insulating base having four continuous faces and two opposed faces, and a plurality of electrically conducting paths that are juxtaposed on at least three continuous faces among the four continuous faces of the insulating base at an insulating interval in a direction where the two opposed faces are arranged, the plurality of electrically conducting paths including:

a plurality of first electrically conducting path portions formed on one of two opposed faces among the three continuous faces at a first pitch for electrically conducting paths equal to the first pitch for electrodes, a plurality of second electrically conducting path portions formed on the other one of the two opposed faces among the three continuous faces at a second pitch for electrically conducting paths equal to the second pitch for electrodes, and a plurality of third electrically conducting path portions formed on the rest of the three continuous faces for connecting the plurality of first electrically conducting path portions and the plurality of second electrically conducting path portions for pitch conversion; and a connector housing mounted to the first circuit substrate with the rectangular parallelepiped connecting element being received therein, wherein the connector housing is configured to:

allow the plurality of electrically conducting path portions disposed on the one of the two opposed faces of the three continuous faces of the rectangular parallelepiped connecting element to be electrically connected to the plurality of first connecting electrodes disposed on the first circuit substrate;

receive a substrate portion of the second circuit substrate where the plurality of second connecting electrodes are disposed and hold the substrate portion in a position where the plurality of electrically conducting path portions disposed on the other face of the two opposed faces among the three continuous faces of the rectangular parallelepiped connecting element are opposed to the plurality of second connecting electrodes; and bring the plurality of second connecting electrodes into contact with the plurality of electrically conducting path portions disposed on the other face.

2. The connector device for interconnecting circuit substrates according to claim 1, wherein the connector housing comprises:

a housing body including:

a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside; and a pushing means that is received in the second receiving chamber and pushes the substrate portion against the connecting element.

3. The connector device for interconnecting circuit substrates according to claim 2, wherein the pushing means is configured to push the substrate portion against the connecting element by means of spring force or elastic force.

4. A connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a given pitch for electrodes, the plurality of second connecting electrodes being juxtaposed on a surface of the second circuit substrate at a given pitch for electrodes, the connector device for interconnecting circuit substrates comprising:

a rectangular parallelepiped connecting element including:

a rectangular parallelepiped insulating base having four continuous faces and two opposed faces, and a plurality of electrically conducting paths that are juxtaposed on at least three continuous faces among the four continuous faces of the insulating base at a given insulating interval in a direction where the two opposed faces are arranged, wherein a pitch for electrically conducting paths of the plurality of electrically conducting paths is substantially equal to the pitch for electrodes; and a connector housing mounted to the first circuit substrate with the rectangular parallelepiped connecting element being received therein, wherein the connector housing is configured to:

allow a plurality of electrically conducting path portions disposed on one of two opposed faces among the three continuous faces of the rectangular parallelepiped connecting element to be electrically connected to the plurality of first connecting electrodes disposed on the first circuit substrate;

receive a substrate portion of the second circuit substrate where the plurality of second connecting electrodes are disposed and hold the substrate portion in a position where a plurality of electrically conducting path portions disposed on the other face of the two opposed faces among the three continuous faces of the rectangular parallelepiped connecting element are opposed to the plurality of second connecting electrodes; and bring the plurality of second connecting electrodes into contact with the plurality of electrically conducting path portions disposed on the other face, and wherein the connector housing comprises:

a housing body including:

a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside; and a pushing means that is received in the second receiving chamber and pushes the substrate portion against the connecting element; the pushing means being configured to push the substrate portion against the connecting element by means of spring force or elastic force.

5. A connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a given pitch for electrodes, the plurality of second connecting electrodes being juxtaposed on a surface of the second circuit substrate at a given pitch for electrodes, the connector device for interconnecting circuit substrates comprising:

a rectangular parallelepiped connecting element including:

a rectangular parallelepiped insulating base having four continuous faces and two opposed faces, and a plurality of electrically conducting paths that are juxtaposed on at least two continuous faces among the four continuous faces of the insulating base at a given insulating interval in a direction where the two opposed faces are arranged wherein a pitch for electrically conducting paths of the plurality of electrically conducting paths is substantially equal to the pitch for electrodes; and a connector housing mounted to the first circuit substrate with the rectangular parallelepiped connecting element being received therein, wherein the connector housing is configured to:

allow the plurality of electrically conducting path portions disposed on one of the two continuous faces of the rectangular parallelepiped connecting element to be electrically connected to the plurality of first connecting electrodes disposed on the first circuit substrate;

receive a substrate portion of the second circuit substrate where the plurality of second connecting electrodes are disposed and hold the substrate portion in a position where the plurality of electrically conducting path portions disposed on the other face of the two continuous faces of the rectangular parallelepiped connecting element are opposed to the plurality of second connecting electrodes; and bring the plurality of second connecting electrodes into contact with the plurality of electrically conducting path portions disposed on the other face, wherein the connector housing comprises:

a housing body including:

a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside; and a pushing means that is received in the second receiving chamber and pushes the substrate portion against the connecting element.

6. The connector device for interconnecting circuit substrates according to claim 5, the pushing means being configured to push the substrate portion against the connecting element by means of spring force or elastic force.

7. A rectangular parallelepiped connecting element for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a first pitch for electrodes, the plurality of second connecting electrodes being juxtaposed on a surface of the second circuit substrate at a second pitch for electrodes of 0.2 mm or less which is different from the first pitch for electrodes, the rectangular parallelepiped connecting element comprising:

a rectangular parallelepiped insulating base having four continuous faces and two opposed faces, and a plurality of electrically conducting paths that are juxtaposed on at least three continuous faces among the four continuous faces of the insulating base at an insulating interval in a direction where the two opposed faces are arranged, the plurality of electrically conducting paths including:

a plurality of first electrically conducting path portions formed on one of two opposed faces among the three continuous faces at a first pitch for electrically conducting paths equal to the first pitch for electrodes, a plurality of second electrically conducting path portions formed on the other one of the two opposed faces among the three continuous faces at a second pitch for electrically conducting paths equal to the second pitch for electrodes, and a plurality of third electrically conducting path portions formed on the rest of the three continuous faces for connecting the plurality of first electrically conducting path portions and the plurality of second electrically conducting path portions for pitch conversion.

* * * * *